US005143566A

United States Patent [19]

Strecker et al.

[11] Patent Number: 5,143,566

[45] Date of Patent: Sep. 1, 1992

[54] COMPOSITE SOLID PROPELLANT WITH A METAL/INORGANIC FLUORIDE ADMIXTURE OR A STABLE BURNING RATE

[75] Inventors: Rüdiger Strecker; Alois Harrer, both of Waldraiburg, Fed. Rep. of Germany

[73] Assignee: Bayern-Chemie GmbH, Aschau, Fed. Rep. of Germany

[21] Appl. No.: 40,396

[22] Filed: May 10, 1979

[30] Foreign Application Priority Data

May 12, 1978 [DE] Fed. Rep. of Germany ..... 2820783

[51] Int. Cl.[5] ..... C06B 45/10

[52] U.S. Cl. ..... 149/19.9; 60/207; 149/19.2; 149/22; 149/119

[58] Field of Search ..... 60/207, 208; 149/19.2, 149/19.9, 19.3, 22, 119, 20

[56] References Cited

U.S. PATENT DOCUMENTS

| | | | |
|---|---|---|---|
| 3,068,641 | 12/1962 | Fox | 60/207 |
| 3,476,622 | 11/1969 | Harada et al. | 149/19.9 |
| 3,646,174 | 2/1972 | Macri | 149/22 |
| 3,753,811 | 8/1973 | Julian et al. | 149/22 |
| 3,761,330 | 9/1973 | Lou et al. | 149/19.2 |
| 3,873,385 | 3/1975 | Henrich et al. | 149/19.9 |
| 3,986,909 | 10/1976 | Macri | 149/19.9 |
| 4,000,024 | 12/1976 | Roberto et al. | 149/19.9 |
| 4,133,173 | 1/1979 | Schadow | 60/207 |
| 4,141,768 | 2/1979 | Lo et al. | 149/19.3 |

OTHER PUBLICATIONS

Hawley, "The Condensed Chemical Dictionary", 9th Ed. p. 240, Van Nostrand Reinhold Co. (1977) New York.

*Primary Examiner*—Edward A. Miller
*Attorney, Agent, or Firm*—Felfe & Lynch

[57] ABSTRACT

A composite solid propellant with a stable burning rate comprising an oxidizer, a binder system of telomeric polybutadiene or copolymers of butadiene and acrylonitrile with terminal functional groups or functional groups distributed statistically along the chain, which are hardened by means of corresponding hardeners into rubber-elastic binders, finely pulverized, readily oxidizable metals and optionally plasticizers and burning rate moderators, wherein one or more of said metals is admixed with inorganic fluorides and incorporated into the composite solid propellant, preferably said metals and said inorganic fluorides are admixed in the form of an agglomerate having a particle size of between 100 μm and 2,000 μm.

8 Claims, No Drawings

COMPOSITE SOLID PROPELLANT WITH A METAL/INORGANIC FLUORIDE ADMIXTURE OR A STABLE BURNING RATE

BACKGROUND OF THE INVENTION

The present invention relates to a composite solid propellant with a stable burning rate on the basis of ammonium perchlorate, telomeric polybutadienes or copolymers of butadiene and acrylonitrile with terminal functional groups or functional groups statistically distributed along the chain, which are hardened with corresponding hardeners into rubber—elastic binders, finely pulverized metals, such as magnesium, aluminum and zirconium and/or semi-metals, such as boron and silicon, and optionally, plasticizers and burning rate moderators.

The solid propellants which are are used as energy sources for rockets usually contain the oxygen required for combustion in the form of solid oxidizers. In contrast thereto, in air-breathing boosters, oxygen from the air is used with simultaneous employment of a strongly under-balanced composite propellant. A strongly under-balanced composite propellant is one where the amount of oxidizer is greatly insufficient to oxidize the finely-pulverized metals. A significant increase in output or range is thereby made possible, because in place of solid oxidizers, additional fuel can be carried. If this fuel partly consists of the metals magnesium, aluminum or zirconium or the semi-metals, such as boron, propellants are obtained which, when burned with air, are far superior not only over the conventional rocket propellants but also over hydrocarbon/air systems, such as kerosene/air, for example.

Such a superiority comes into play only if during the combustion of the propellant a good combustion effect degree is also achieved. In these cases difficulties arise, especially when large amounts of boron or zirconium are used, which threaten to cancel out the above-mentioned advantages.

OBJECTS OF THE INVENTION

It is an object of the invention to provide a composite propellant for air-breathing boosters with improved combustion effect degree.

Another object of the present invention is the obtaining of a composite solid propellant with a stable burning rate comprising an oxidizer, a binder system of telomeric polybutadiene or copolymers of butadiene and acrylonitrile with terminal functional groups or functional groups distributed statistically along the chain, which are hardened by means of corresponding hardeners into rubber-elastic binders, finely pulverized, readily oxidizable metals and optionally plasticizers and burning rate moderators, wherein one or more of said metals is admixed with inorganic fluorides and incorporated into the composite solid propellant.

A further object of the present invention is the development of a composite solid propellant with a stable burning rate consisting essentially of:

15% to 40% by weight of an ammonium perchlorate oxidizer,

20% to 65% by weight of an agglomerate consisting of: 80% to 96% by weight of boron with a purity of 86% to 99%, and an average particle size of 0.5 μm to 5 μm, 1% to 15% by weight of fluorides selected from the group consisting of the alkali metal fluorides and cryolites of the alkali metals of the formula $$Me_3AlF_6$$

where M is an alkali metal, as well as an agglomeration auxiliary agent in amounts of 1% to 10% by weight, 0% to 10% by weight of finely pulverized, readily oxidizable metals, 10% to 40% by weight of a binder system selected from the group consisting of telomeric polybutadiene and copolymers of butadiene and acrylonitrile, both with terminal functional groups or functional groups distributed statistically along the chain, which are hardened by means of corresponding hardeners into rubber-elastic binders, and 0% to 5% by weight of burning rate moderators. A still further object of the present invention is the development of an agglomerated boron inorganic fluoride for use in a solid propellant having a stable burning rate consisting essentially of:

80% to 96% by weight of boron with a purity of 86% to 99%, and an average particle size of 0.5 μm to 5 μm, 1% to 15% by weight of fluorides selected from the group consisting of the alkali metal fluorides and cryolites of the alkali metals of the formula $$M_3AlF_6$$

where M is an alkali metal, as well as an agglomeration auxiliary agent in amounts of 1% to 10% by weight.

These and other objects of the invention will become more apparent as the description thereof proceeds.

DESCRIPTION OF THE INVENTION

The drawbacks of the prior art are overcome and the above objects are achieved where one or more of the finely-divided metals customarily employed in composite solid propellants for air breathing boosters, are admixed with an inorganic fluoride, preferably in an agglomerated form, in the composite solid propellant to give an improved combustion effect degree.

More particularly, the present invention relates , to a composite solid propellant with a stable burning rate comprising an oxidizer, a binder system of telomeric polybutadiene or copolymers of butadiene and acrylonitrile with terminal functional groups or functional groups distributed statistically along the chain, which are hardened by means of corresponding hardeners into rubber-elastic binders, finely pulverized, readily oxidizable metals and optionally plasticizers and burning rate moderators, wherein one or more of said metals is admixed with inorganic fluorides and incorporated into the composite solid propellant; and in particular, the above composite solid propellant wherein said metal/fluoride mixture is an agglomerate consisting of:

80% to 96% by weight of boron with a purity of 86% to 99%, and an average particle size of 0.5 μm to 5 μm, 1% to 15% by weight of fluorides selected from the group consisting of the alkali metal fluorides and cryolites of the alkali metals of the formula $$Me_3AlF_6$$

where M is an alkali metal, as well as an agglomeration auxiliary agent in amounts of 1% to 10% by weight, where the agglomerate has a particle size of 100 μm to 2,000 μm.

For the purpose of the invention, the propellants are admixed with inorganic fluorine compounds of the first and second main group of the periodic system or double fluorides with elements of the third main group, especially LiF, NaF, KF, $MgF_2$, $CaF_2$, as well as the double fluorides $NaBF_4$, $Li_3AlF_6$, $Na_3AlF_6$, $K_3AlF_6$. The addition of these salts to the composite solid propellants in the concentration range of between 1% and 5%, but preferably 3%, already improves the combustion effect degree from a value of 50% to 65% for propellants *without* the additive, up to 70% to 80% for propellants *with* the additive.

A further increase of the combustion effect degree up to 90% to 97% is achieved if boron with an average particle size of about 1.5 μm used as the main fuel is agglomerated with the inorganic fluoride into larger particles.

Therefore, the agglomerate according to the invention consists in a preferred embodiment of 80% to 96% by weight, preferably 85% to 90% by weight, of boron with a purity of 86% to 99%, preferably 95% to 97%, and an average particle size of 0.5 μm to 5 μm, preferably 1 μm to 3 μm; 1% to 15% by weight, preferably 2% to 10% by weight, of alkali metal fluorides and/or cryolites of the alkali metals of the formula $$M_3AlF_6$$

where M is an alkali metal, as well as an agglomeration auxiliary agent in an amount of 1% to 10% by weight, preferably 4% to 6% by weight.

This agglomerate, pursuant to a further characteristic, has a particle size between 100 μm and 2,000 μm, preferably between 200 μm and 1,200 μm. The agglomeration auxiliary agent consists, in accordance with an advantageous embodiment, of organic solvent-soluble polymers, such as polymethylmethacrylate, polystyrene, polyamides, polyvinylpyrrolidone or polyester resins.

The preparation of the agglomerate is given in the examples. Of course, the indicated composition of the agglomerate represents only one of the many possible compositions.

In accordance with an advantageous embodiment of the invention, the propellants prepared by incorporating the agglomerate have the following composition (in percent by weight):

Oxidizers 15 to 40%

Metals 0 to 10%

Binder system (binders plasticizers, process excipients) 10% to 40%

Burning rate moderators 0 to 5%.

More particularly, an advantageous composite propellant with a stable burning rate consists essentially of:

15% to 40% by weight of an ammonium perchlorate oxidizer,

20% to 65% by weight of an agglomerate consisting of 80% to 96% by weight of boron with a purity of 86% to 99%, and an average particle size of 0.5 μm to 5 μm, 1% to 15% by weight of fluorides selected from the group consisting of the alkali metal fluorides and cryolites of the alkali metals of the formula $$Me_3AlF_6$$

where M is an alkali metal, as well as an agglomeration auxiliary agent in amounts of 1% to 10% by weight, 0% to 10% by weight of finely pulverized, readily oxidizable metals, 10% to 40% by weight of a binder system selected from the group consisting of telomeric polybutadiene and copolymers of butadiene and acrylonitrile, both with terminal functional groups or functional groups distributed statistically along the chain, which are hardened by means of corresponding hardeners into rubber-elastic binders, and 0 to 5% by weight of burning rate moderators.

For increasing the output of air-breathing boosters, one or more light metals, their alloys, semi-metals or metals are added to the propellant. In most cases, the propellant contains several of the above-mentioned components. These fuels, which are present in finely pulverized form with a particle size between 0.5 μm and 20 μm, are employed in amounts of 25% to 60%, prefer between 40% and 50%. Suitable light metals are, for example, magnesium and aluminum. Suitable semi-metals are boron and silicon, and a suitable metal is zirconium. As already mentioned, these fuels are agglomerated with the inorganic fluorides into larger particles prior to use. The oxidizers, which are employed in concentrations of 15% to 40%, consist of alkali metal, ammonium and alkaline earth metal salts of nitric acid and/or perchloric acid. For this purpose, the employment of ammonium perchlorate and/or sodium nitrate proves to be particularly advantageous. Other oxidizers which may be used within the scope of the invention are the nitramines, RDX, HMX, nitroguanidine, guanidine nitrate, triaminoguanidine nitrate, etc.

Preferred as binders are telomeric polymers, such as polybutadienes or copolymers of butadiene and acrylonitrile, polyesters or polyethers with functional groups. The functional groups may either be in terminal position or statistically distributed along the chain. Typical examples are terminal carboxyl-substituted polyesters and polybutadienes, terminal hydroxyl-substituted polybutadienes and polyesters or copolymers of butadiene and acrylic acid as well as terpolymers of butadiene/acrylic acid/acrylonitrile. The last two are prepared by a complete or partial hydrolysis of a butadiene-acrylonitrile copolymer.

If the functional group consists of a carboxyl group, these polymers can be hardened with various aziridines, epoxides or amines. Polymers with hydroxyl groups are hardened with aliphatic or aromatic di- or polyisocyanates. Depending upon the reactivity of the isocyanate which is used, hardening accelerators or hardening inhibitors are added.

In accordance with a further characteristic of the invention, the binder system consists of 8% to 20% by weight of the total propellant of polybutadiene or copolymers of butadiene and acrylonitrile with functional groups; 0.5% to 5% by weight of the total propellant of hardener; and 0% to 20% by weight of the total propellant of plasticizer.

The binder system may, of course, also be modified with components which do not take part in the hardening process, such as aliphatic or aromatic hydrocarbons and esters with a plasticizing function, process auxiliaries, anti-oxidizing agents, etc.

The compounds which are conventional in propellant technology are used as burning rate moderators. Among these are, for example, iron oxide, copper chromite, copper oxide, manganese oxide, n-butylferrocene, organic iron compounds, such as ferrocene, catocenes, etc. Depending upon the required burning rate of the propellant, these moderators are added in the concentration range of between 0% to 5%.

For further illustration of the invention, the following working examples of the invention are given, which in no way limit the invention.

EXAMPLES

Example A

Preparation of the Metal/Fluoride Agglomerate

The preparation of the agglomerate is briefly described below. Of course, the indicated composition of the agglomerate represents only one of the many possible compositions.

2.2 Parts by weight of polymethylmethacrylate were dissolved in 50 parts by weight of methylene chloride. This solution was introduced into a horizontal mixer with sigma-kneading blades, and first 3.8 parts of the inorganic fluoride compound, such as LiF, and then 44 parts of the metal, such as metallic boron, with a particle size of 0.5 μm and 5 μm were added in portions. After the mass was homogenized by prolonged mixing, the solvent was slowly evaporated off at a pressure of 200 mm to 500 mm Hg at room temperature while continuing the kneading. The kneaded mass was progressively dried thereby and then disintegrated into a grainy agglomerate. By means of screening, the agglomerate with the desired particle size of preferably under 1,200 μm is then continuously removed, whereas the excessively large particles are recycled into the kneading process. The agglomerate is then dried at 80° C. until it has a constant weight.

Other metals than boron may be employed, such as the semi-metal silicon. Likewise other fluorides than LiF may be employed, such as $K_3AlF_6$, $Na_3AlF_6$, $Li_3AlF_6$, etc.

EXAMPLE 1

Comparison

| Percent by Weight | |
|---|---|
| 42.0 | Boron, having a particle size between 0.5 μm and 5 μm |
| 8.0 | Aluminum, having a particle size between 0.5 μm and 20 μm |
| 25.0 | Ammonium perchlorate |
| 5.0 | n-Butyl-ferrocene |
| 13.0 | Terminally-carboxylated polybutadiene |
| 6.5 | Isodecyl pelargonate |
| 0.5 | Epoxide/aziridine hardener. |

The components are admixed at 70° C. into a pourable mass, which, after five days at 80° C., hardens into a rubber-elastic mass. The burn rate at 20° C. and 30 bar is 11 mm/sec. The combusion effect degree after afterburning with air is between 50% and 65% (depending upon the air/propellant mixture ratio).

EXAMPLE 2

| Percent by Weight | |
|---|---|
| 42.0 | Boron |
| 8.0 | Aluminum |
| 3.0 | Lithium fluoride |
| 25.0 | Ammonium perchlorate |
| 5.0 | n-Butyl-ferrocene |
| 13.0 | Terminal carboxyl-substituted polybutadiene |
| 3.5 | Isodecyl pelargonate |
| 0.5 | Epoxide/aziridine hardener. |

The compounding is carried out as in the preceding example. A rubber-elastic composite propellant is obtained with a burn rate of 13 mm/sec. at 20° C. and 30 bar. The combustion effect degree after afterburning with air is between 70% and 80%.

EXAMPLE 3

| Percent by Weight | |
|---|---|
| 45.0 | Boron/LiF-agglomerate of 42% boron and 3% LiF, having a particle size of between 200 μm and 1,200 μm |
| 8.0 | Aluminum |
| 25.0 | Ammoniun perchlorate |
| 5.0 | n-Butyl-ferrocene |
| 13.0 | Terminal carboxyl-substituted polybutadiene |
| 3.5 | Isodecyl pelargonate |
| 0.5 | Epoxide/aziridine hardener. |

The compounding is carried out as in the preceding examples. The burn rate of the propellant at 20° C. and 30 bar is 22 mm/second. The combustion effect degree of the propellant after afterburning with air is between 92% to 96%.

EXAMPLE 4

| Percent by Weight | |
|---|---|
| 45.0 | Boron/LiF-agglomerate of 42% boron and 3% LiF, having a particle size of between 200 μm and 1,200 μm |
| 8.0 | Aluminum |
| 25.0 | Ammonium perchlorate |
| 1.0 | n-Butyl-ferrocene |
| 13.0 | Terminal carboxyl-substituted polybutadiene |
| 7.5 | Isodecyl pelargonate |
| 0.5 | Epoxide/aziridine hardener. |

The compounding is carried out as in the preceding examples. The burn rate of the propellant at 20° C. and 30 bar is 12 mm/sec. The combustion effect degree after afterburning with air is between 92% and 96%.

EXAMPLE 5

| Percent by Weight | |
|---|---|
| 45.0 | Boron/LiF-agglomerate of 42% boron and 3% LiF, having a particle size of between 200 μm and 1,200 μm |
| 8.0 | Aluminum |
| 25.0 | Ammonium perchlorate |
| 1.0 | n-Butyl-ferrocene |
| 10.0 | Terminal hydroxyl-substituted polybutadiene |
| 8.2 | Diisooctyl sebacate |

-continued

| Percent by Weight | |
|---|---|
| 2.8 | Diisocyanate hardener |

The components are admixed at 50° C. into a pourable mass which, after eight days at 50° C., hardens into a rubber-elastic mass. The burn rate of the propellant at 20° C. and 30 bar is 12 mm/sec. The combustion effect degree after afterburning with air is between 92% and 96%.

EXAMPLE 6

| Percent by Weight | |
|---|---|
| 45.0 | Boron/LiF-agglomerate of 42% boron and 3% LiF, having a particle size of between 200 μm and 1,200 μm |
| 8.0 | Magnesium, having a particle size of between 0.5 μm and 20 μm |
| 25.0 | Ammonium perchlorate |
| 1.0 | n-Butyl-ferrocene |
| 11.5 | Terminal carboxyl-substituted polybutadiene |
| 9.0 | Naphthenic plasticizer |
| 0.5 | Epoxide/aziridine hardener |

After compounding as in Example 1, the burn rate of the propellant at 20° C. and 30 bar is 11 mm/sec. The combusion effect degree after afterburning with air is between 88% and 92%.

EXAMPLE 7

| Percent by Weight | |
|---|---|
| 45.0 | Boron/LiF-agglomerate of 42% boron and 3% $Li_3AlF_6$, having a particle size of between 200 μm and 1,200 μm |
| 8.0 | Aluminum |
| 25.0 | Ammonium perchlorate |
| 1.0 | n-Butyl-ferrocene |
| 11.5 | Terminal carboxyl-substituted polybutadiene |
| 9.0 | Naphthenic plasticizer |
| 0.5 | Epoxide/aziridine hardener. |

After compounding as in Example 1, the burn rate of the propellant at 20° C. and 30 bar is 13 mm/sec. The combustion effect degree after afterburning with air is between 93% and 97%.

EXAMPLE 8

| Percent by Weight | |
|---|---|
| 45.0 | Boron/$Na_3AlF_6$-agglomerate of 41.5% boron and 3.5 $Na_3AlF_6$, having a particle size of between 200 μm and 1,200 μm |
| 8.0 | Aluminum |
| 25.0 | Ammonium perchlorate |
| 1.0 | n-Butyl-ferrocene |
| 11.5 | Terminal carboxyl-substituted polybutadiene |
| 9.0 | Naphthenic plasticizer |
| 0.5 | Epoxide/aziridine hardener. |

After compounding as in Example 1, the burn rate of the propellant at 20° C. and 30 bar is 8 mm/sec. The combustion effect degree after afterburning with air is between 90% and 94%.

EXAMPLE 9

| Percent by Weight | |
|---|---|
| 45.0 | Boron/$K_3AlF_6$-agglomerate of 41% boron and 4% $K_3AlF_6$, having a particle size of between 200 μm and 1,200 μm |
| 8.0 | Aluminum |
| 25.0 | Ammonium perchlorate |
| 1.0 | n-Butyl-ferrocene |
| 11.5 | Terminal carboxyl-substituted polybutadiene |
| 9.0 | Naphthenic plasticizer |
| 0.5 | Epoxide/aziridine hardener. |

After compounding as in Example 1, the burn rate of the propellant at 20° C. and 30 bar is 10 mm/sec. The combustion effect degree after afterburning with air is between 90% and 94%.

EXAMPLE 10

| Percent by Weight | |
|---|---|
| 45.0 | Boron/LiF-agglomerate of 42% boron and 3% LiF, having a particle size of between 200 μm and 1,200 μm |
| 6.0 | Aluminum |
| 25.0 | Ammonium perchlorate |
| 2.0 | Nitro-guanidine |
| 10.0 | Terminal hydroxyl-substituted polybutadiene |
| 9.2 | Naphthenic plasticizer |
| 2.8 | Diisocyanate hardener. |

After compounding as in Example 5, the burn rate of the propellant at 20° C. and 30 bar is 4 mm/sec. The combustion effect degree after afterburning with air is between 92% and 96%.

EXAMPLE 11

| Percent by Weight | |
|---|---|
| 50.0 | Boron/LiF-agglomerate of 47% boron and 3% LiF, having a particle size of between 200 μm and 1,200 μm |
| 6.0 | Aluminum |
| 22.0 | Ammonium perchlorate |
| 1.0 | n-Butyl-ferrocene |
| 11.5 | Terminal carboxyl-substituted polybutadiene |
| 9.0 | Naphthenic plasticizer |
| 0.5 | Epoxide/aziridine hardener |

After compounding as in Example 1, the burn rate of the propellant is 9 mm/sec. at 20° C. and 30 bar. The combustion effect degree after afterburning with air is between 90% and 94%.

The preceding specific examples are illustrative of the practice of the invention. It is to be understood, however, that other expedients known to those skilled in the art or disclosed herein, may be employed without departing from the spirit of the invention or the scope of the appended claims.

We claim:

1. A composite solid propellant with a stable burning rate comprising an oxidizer, a binder system of telomeric polybutadiene or copolymers of butadiene and acrylonitrile with terminal functional groups or functional groups distributed statistically along the chain, which are hardened by means of corresponding hardeners into rubber-elastic binders, finely pulverized, readily oxidizable metals and optionally plasticizers and burning rate moderators, wherein one or more of said metals is agglomerated with inorganic fluorides and said agglomerate is incorporated into the composite solid propellant, wherein said agglomerate consists of 80% to 96% by weight, of boron with a purity of 86% to 99%, and an average particle size of 0.5 μm to 5 μm, 1% to 15% by weight of fluorides selected from the group consisting of the alkali metal fluorides and cryolites of the alkali metals of the formula:

$M_3AlF_6$ where M is an alkali metal, as well as an agglomeration auxiliary agent in amounts of 1% to 10% by weight, said agglomerate having a particle size of between 100 μm and 2,000 μm.

2. The composite solid propellant of claim 1 wherein said agglomerate consists of 85% to 90% by weight of boron, with a purity of 95% to 97% and an average particle size of from 1 μm to 3 μm.

3. The composite solid propellant of claim 1 wherein said agglomerate consists of from 2% to 10% by weight of said fluorides and 4% to 6% by weight of said agglomeration auxiliary agent.

4. The composite solid propellant of claim 1 wherein said agglomerate has a particle size between 200 μm and 1,200 μm.

5. The composite solid propellant of claim 1 wherein said agglomeration auxiliary agent is soluble in an organic solvent and is selected from the group consisting of polymethylmethacrylate, polystyrene, polyamides, polyvinylpyrrolidone and polyester resins.

6. A composite solid propellant with a stable burning rate consisting essentially of:

15% to 40% by weight of an ammonium perchlorate oxidizer,

20% to 65% by weight of an agglomerate consisting of 80% to 96% by weight of boron with a purity of 86% to 99%, and an average particle size of 0.5 μm to 5 μm.

1% to 15% by weight of fluorides selected from the group consisting of the alkali metal fluorides and cryolites of the alkali metals of the formula $M_3AlF_6$ where M is an alkali metal, as well as an agglomeration auxiliary agent in amounts of 1% to 10% by weight, 0% to 10% by weight of finely pulverized, readily oxidizable metals, 10% to 40% by weight of a binder system selected from the group consisting of telomeric polybutadiene and copolymers of butadiene and acrylonitrile, both with terminal functional groups or functional groups distributed statistically along the chain, which are hardened by means of corresponding hardeners into rubber-elastic binders, and 0% to 5% by weight of burning rate moderators.

7. The composite solid propellant of claim 6 wherein said 10% to 40% by weight of binder system consists of:

8% to 20% by weight of the total propellant of said polybutadiene or copolymers of butadiene and acrylonitrile, with said functional groups, 0.5% to 5% by weight of the total propellant of said hardener, and 0% to 20% by weight of the total propellant of plasticizers.

8. An agglomerated boron/inorganic fluoride for use in a solid propellant having a stable burning rate consisting essentially of:

80% to 96% by weight of 80% to 99%, and an average particle size of 0.5 μm to 5 μm, 1% to 15% by weight of fluorides selected from the group consisting of the alkali metal fluorides and cryolites of the alkali metals of the formula:

$Me_3AlF_6$ where M is an alkali metal, as well as an agglomeration auxiliary agent in amounts of 1% to 10% by weight, said agglomerate having a particle size of between 100 μm and 2,000 μm.

* * * * *

UNITED STATES PATENT AND TRADEMARK OFFICE

CERTIFICATE OF CORRECTION

PATENT NO. : 5,143,566

DATED : September 1, 1992

INVENTOR(S) : Rüdiger Strecker et al

It is certified that error appears in the above-identified patent and that said Letters Patent is hereby corrected as shown below:

Column 2, lines 5 and 67 and

Column 4, line 5, per amendment, "$Me_3AlF_6$" should read

--$M_3AlF_6$--.

Column 10, line 32, before "80%" (second occurrence), insert --boron with a purity of--.

Column 10, line 38, "$Me_3AlF_6$" should read

--$M_3AlF_6$--.

Signed and Sealed this

First Day of February, 1994

*Attest:*

Bruce Lehman

BRUCE LEHMAN

*Attesting Officer*

*Commissioner of Patents and Trademarks*